US009953786B2

(12) United States Patent
Mecklenburg

(10) Patent No.: US 9,953,786 B2
(45) Date of Patent: Apr. 24, 2018

(54) SELF-HOLDING MAGNET WITH A PARTICULARLY LOW ELECTRIC TRIGGER VOLTAGE

(71) Applicant: RHEFOR GBR (VERTRETEN DURCH DEN GESCHÄFTSFÜHRENDEN GESELLSCHAFTER ARNO MECKLENBURG), Berlin (DE)

(72) Inventor: Arno Mecklenburg, Berlin (DE)

(73) Assignee: Rhefor GbR (Vertreten Durch den Geschaeftsfuehrenden Gesellschafter Arno Mecklenburg), Berlin (DE)

( * ) Notice: Subject to any disclaimer, the term of this patent is extended or adjusted under 35 U.S.C. 154(b) by 0 days.

(21) Appl. No.: 14/900,206

(22) PCT Filed: Jun. 20, 2014

(86) PCT No.: PCT/EP2014/063042
§ 371 (c)(1),
(2) Date: Dec. 21, 2015

(87) PCT Pub. No.: WO2014/202761
PCT Pub. Date: Dec. 24, 2014

(65) Prior Publication Data

US 2016/0148769 A1 May 26, 2016

(30) Foreign Application Priority Data

Jun. 20, 2013 (DE) ..... 10 2013 010 204
Aug. 19, 2013 (DE) ..... 10 2013 013 585

(51) Int. Cl.
*H01H 9/00* (2006.01)
*H01H 50/16* (2006.01)
(Continued)

(52) U.S. Cl.
CPC ..... *H01H 50/163* (2013.01); *H01F 7/1646* (2013.01); *H01H 50/22* (2013.01);
(Continued)

(58) Field of Classification Search
CPC ..... H01F 7/122; H01F 7/1615; H01F 7/1646; H01F 7/083; H01F 7/081; H01F 1/057;
(Continued)

(56) References Cited

U.S. PATENT DOCUMENTS 2,130,870 A 9/1938 Boehne
2,278,971 A * 4/1942 Boehne ..... H01H 51/01 335/14

(Continued)

FOREIGN PATENT DOCUMENTS

DE 943479 C 5/1956
DE 102011014192 A1 9/2012

(Continued)

*Primary Examiner* — Shawki S Ismail
*Assistant Examiner* — Lisa Homza
(74) *Attorney, Agent, or Firm* — Laurence A. Greenberg; Werner H. Stemer; Ralph E. Locher

(57) ABSTRACT

A self-holding magnet has a spring (accumulator spring) and a first armature. The self-holding magnet is capable of holding the first magnet armature against the spring force in a lift position which is determined by a stop. The stop determines a remaining air gap of a working air gap. The magnetic circuit of the self-holding magnet has a magnetic shunt with particularly low reluctance of the same order of magnitude as a series reluctance of the remaining working air gap(s). The working air gap(s) and the shunt are magnetically connected in parallel with the flow generated by a permanent magnet but in series with the flow generated by the trigger coil. The self-holding magnet additionally has at least one positive feedback device such as a compressible resilient stop or a shunt.

11 Claims, 4 Drawing Sheets

(51) Int. Cl.
*H01F 7/16* (2006.01)
*H01H 50/22* (2006.01)
*H01H 50/30* (2006.01)
*H01H 50/36* (2006.01)

(52) U.S. Cl.
CPC ..... *H01H 50/30* (2013.01); *H01H 50/36* (2013.01); *H01F 2007/1669* (2013.01)

(58) Field of Classification Search
CPC .... H01H 51/2209; H01H 50/36; H01H 50/42; H01H 50/18; E05B 47/00
USPC ..... 335/179
See application file for complete search history.

(56) References Cited

U.S. PATENT DOCUMENTS 2,310,138 A * 2/1943 Whittaker ..... H01H 36/00 200/19.36
2,919,324 A * 12/1959 Schuessler ..... H01H 51/12 335/126
3,119,940 A * 1/1964 Pettit ..... H01F 7/1615 310/15
3,371,297 A * 2/1968 Ridings ..... H01F 7/1615 335/170
3,444,490 A 5/1969 Krummel et al.
3,639,871 A * 2/1972 Trbovich ..... H02K 33/18 310/36
3,783,423 A * 1/1974 Mater ..... H01H 71/322 335/174
3,792,390 A * 2/1974 Boyd ..... H01H 71/322 335/174
3,886,507 A * 5/1975 Johnston ..... H01H 51/2209 335/170
4,072,918 A * 2/1978 Read, Jr. ..... H01F 7/1646 335/174
4,144,514 A * 3/1979 Rinde ..... H01F 7/13 137/551
4,157,520 A * 6/1979 Moates ..... H02H 3/34 335/229
4,191,937 A * 3/1980 Koehler ..... H01F 7/14 335/230
4,251,789 A * 2/1981 Russell ..... H01H 71/04 335/174
4,253,493 A * 3/1981 English ..... F01L 9/04 137/625.18
4,644,311 A * 2/1987 Guery ..... H01H 51/2209 335/230
4,737,750 A * 4/1988 Prouty ..... H01H 51/2209 335/177
4,761,575 A * 8/1988 Reder ..... H01F 7/088 137/625.62
4,774,485 A * 9/1988 Dietrich ..... H01H 51/2209 335/230
4,829,947 A * 5/1989 Lequesne ..... F01L 9/04 123/90.11
4,847,581 A * 7/1989 Mohler ..... H01F 7/1646 335/229
4,851,801 A * 7/1989 Engel ..... H01H 51/2209 335/230
4,876,521 A * 10/1989 Boyd ..... H01H 71/322 335/179
4,954,799 A * 9/1990 Kumar ..... H01F 7/13 251/129.08
5,010,911 A * 4/1991 Grant ..... F16K 31/082 137/68.3
5,032,812 A * 7/1991 Banick ..... F16K 31/082 335/17
5,327,112 A * 7/1994 Rossetti ..... H01H 83/144 335/18
5,351,934 A * 10/1994 Jensen ..... F16K 1/123 251/129.1
5,387,892 A * 2/1995 Rossetti ..... H01H 71/322 29/607
5,452,172 A * 9/1995 Lane ..... H01F 7/1615 361/71
5,959,519 A * 9/1999 Gobel ..... H01F 7/1615 335/132
6,130,594 A 10/2000 Morant et al.
6,285,270 B1 9/2001 Lane et al.
6,646,529 B1 * 11/2003 Kahnert ..... H01H 71/322 335/229
7,557,681 B2 * 7/2009 Whitaker ..... H01H 71/0228 335/14
7,598,830 B2 * 10/2009 Bogdon ..... H01H 50/22 335/14
7,982,567 B2 * 7/2011 Cartier Millon ... H01H 51/2209 335/131
8,138,863 B2 * 3/2012 Tanaka ..... H01H 1/54 335/126
8,179,217 B2 * 5/2012 Kawaguchi ..... H01F 7/1615 335/124
8,228,149 B2 * 7/2012 Puth ..... H01F 7/1615 335/220
8,975,992 B2 * 3/2015 Bottcher ..... H01H 3/28 335/179
2004/0066261 A1 * 4/2004 Nishida ..... H01H 51/2209 335/179
2007/0200653 A1 * 8/2007 Matsumoto ..... H01F 7/122 335/179
2011/0248804 A1 * 10/2011 Wygnanski ..... H01F 7/1646 335/230
2012/0169441 A1 * 7/2012 Kim ..... H01F 7/1615 335/179
2012/0293287 A1 * 11/2012 Lauraire ..... H01H 3/28 335/229
2013/0222083 A1 * 8/2013 Gu ..... H01H 3/28 335/179
2014/0002218 A1 1/2014 Bory et al.
2016/0125990 A1 * 5/2016 Strigerwald ..... F01L 13/0036 335/229
2016/0172137 A1 * 6/2016 Liang ..... H01H 50/16 335/179
2016/0268032 A1 * 9/2016 Mecklenburg ..... H01F 7/122

FOREIGN PATENT DOCUMENTS

GB 765411 1/1957
WO 9933078 A 7/1999

* cited by examiner

SELF-HOLDING MAGNET WITH A PARTICULARLY LOW ELECTRIC TRIGGER VOLTAGE

TECHNICAL FIELD

The invention relates to the field of electromagnetic actuators.

BACKGROUND OF THE INVENTION

So-called self-holding magnets are generally known and commonly used (see e.g.: E. Kallenbach, R. Eick, P. Quendt, T. Ströhla, K. Feindt, M. Kallenbach: Elektromagnete (2008), Chapter 9.2 Polarisierte Magnete, p. 298).

These are permanently polarized electromagnets which can be switched off: By means of permanent magnets, self-holding magnets are able to stably hold a (magnetic) armature in at least one position, wherein, as required, a counter-excitation can be generated by means of a coil ("trigger coil"), which compensates the permanent-magnetically generated field to such an extent that the armature position no longer is stable. It is known to provide a magnetic shunt in self-holding magnets. With respect to the permanent-magnetically generated flux, the shunt is connected in parallel with the one or more working air gaps of the armature. With respect to the flux generated by the coil, however, they are connected in series. The shunt hence on the one hand reduces the electric power required for the compensation of the permanent-magnetically generated field; on the other hand, the one or more permanent magnets are protected against demagnetization. Self-holding magnets often are combined with springs and with the same form electrically triggerable spring accumulators. The spring hence acts on the armature, in order to open the one or more working air gaps. The self-holding magnet, however, is designed such that when the gap size falls below a certain minimum air gap, a residual air gap remains, which is able to hold the spring in the tensioned condition.

By energizing the trigger coil, a counter-excitation can be generated such that the magnetic holding force becomes smaller than the spring force and the armature starts to move, wherein the elastic energy previously stored in the spring can be utilized to perform work. Such "magnetic spring accumulators" are needed for example as trips, in particular fault current trips, in electric switching devices, for example in circuit breakers. What is also generally known is the use as fault current trip in fault current protective switches. In addition, they are used in locking units ("locking magnets"), wherein tensioning can be effected mechanically or also by inverse excitation of the magnet by means of the coil (excitation instead of counter-excitation such as on triggering). To facilitate magnetic tensioning, influencing of characteristics can be utilized, whereby with fully open working air gap far higher force constants can be obtained.

In battery-operated locking units a low triggering current is particularly desirable. The same applies for the trips of electric switching devices, namely in particular for fault current trips of low- and medium-voltage switching devices with their own power supply. Trips, above all fault current trips, furthermore should react as fast as possible, i.e. have short dead times. Of such trips it also must be requested that they can be designed such that an excessive counter-excitation does not inadvertently prevent or inadmissibly slow down triggering: An overcompensation of the permanent-magnetically generated field and hence of the associated holding force can result in the formation of a holding force due to the flux linked with the triggering current, so that the self-holding magnet is triggered with a delay or not at all. Triggering magnets so to speak must of course be quite insensitive to vibrations, inadvertent triggering as a result of shocks or other vibrations should be rendered extremely difficult, which is why the desired high electrical sensitivity—i.e. the desired low triggering currents and powers—cannot be realized easily, in that magnetic holding force and spring force are adapted to each other as closely as possible.

BRIEF SUMMARY OF THE INVENTION

Hence, it is the object of the invention: A self-holding magnet with spring ("magnetic spring accumulator") which as compared to known types has a particularly low electric triggering power. In addition, the magnetic spring accumulator should have the following features, as required:

- short dead time, i.e. short time between start of energization and starting armature movement,
- no failure, even in the case of high counter-excitations, as compared to usual self-holding magnets.

The invention proceeds from a self-holding magnet with spring, wherein the self-holding magnet includes a stop for the armature as well as a magnetic shunt. In the tensioned condition, the armature of the self-holding magnet is permanent-magnetically held against the spring force, the working air gap (or the working air gaps, if an armature with several pole surfaces is used) is closed except for a residual (working) air gap given by the stop, wherein the frame of the self-holding magnet (as armature counterpart) itself can serve as stop, possibly with an anti-stick film or the like.

The shunt has a particularly low reluctance: According to the invention, the shunt is to be dimensioned such that its reluctance in the tensioned condition is of the same order of magnitude and possibly as large as the reluctance of the residual (working) air gap (or the sum of the reluctances of the residual working air gaps, if a series connection of several working air gaps is present; this is the case e.g. in pole plates in which two poles engage the same surface).

With respect to the permanent-magnetically generated flux, working air gap(s) and shut magnetically are connected in parallel. With respect to the flux to be generated by the coil, however, they are connected in series. The reluctance of the shunt, as already mentioned, is of the same order of magnitude as the reluctance of the residual (working) air gap and possibly as large as the same. Flux-carrying parasitic residual air gaps likewise are to be considered corresponding to their arrangement. In any case, an electric counter-excitation of the self-holding magnet leads to the fact that the flux density in the working air gap(s) is reduced, while the flux density in the shunt increases.

With respect to the flux-carrying cross-sections, the shunt partial circuit also can be designed such that as a result of magnetic saturation the reluctance of the iron circuit "seen" by the coil increases with increasing counter-excitation such that even a comparatively strong counter-excitation is not able to retain the armature against the spring force (since the flux density in the shunt increases with increasing counter-excitation). For this purpose, the shunt partial circuit can have a rather constant, smallest effective cross-section along a certain (minimum) length. The shunt can be defined geometrically; it can, however, also be formed of a soft magnetic material of comparatively low (macroscopic) permeability, in particular of a sinter material with distributed air gap, which can simplify the manufacture.

In contrast to known self-holding magnets, a self-holding magnet according to the invention also includes one or more of the following three positive feedback devices:

1. Resilient stop
2.1. Variable shunt through execution as reversing stroke magnet
2.2. Variable shunt with second armature ("shunt armature")

Explanation:

1. Resilient Stop

In conventional self-holding magnets with spring ("accumulator spring") the stop can be regarded as rigid in good approximation. In these drives, the armature therefore only starts to move when as a result of the electric counter-excitation the magnetic holding force falls below the acting (detaching) spring force of the accumulator spring. This is not the case when the stop itself is capable of compression. However, in order to satisfy the requirement of small triggering powers with sufficient vibration resistance, the residual air gap produced by means of the stop should be small. Correspondingly, the resilient sop should have a suitable stiffness: On the one hand, the stop should be far stiffer than the "first" spring of the self-holding magnet ("accumulator spring") serving the elastic energy storage. On the other hand, the resilient stop however should be far less stiff than a solid stop (of an iron material). For example, the stop can be 100 to 10.000 times as stiff as the "first" spring (accumulator spring). The stop by no means should have a linear characteristic, but for example can also be degressive and be constructed by means of bending springs, in particular by a disk spring. The resilient stop also can be pretensioned. Furthermore, the stop can be designed adjustable, for example with fine threads, so that its pretension and/or rest position can be adjusted, in order to adjust the trigger characteristic. In summary, the "first" spring (accumulator spring) and the "second" spring, namely the resilient stop, together form a combined spring with highly progressive characteristic based on their action on the armature. The resilient stop permits that already a very small counter-excitation results in a certain (small) movement of the armature. However, since according to the invention the shunt has a very small reluctance, very small deflections of the armature from its (closed, tensioned) stroke starting position already lead to the fact that the flux via the shunt considerably increases and the flux via the working air gap(s) noticeably decreases, wherein the associated magnetic holding force of course develops in proportion to the square of the flux density in the working air gap. The small deflection of the armature, which as a result of the resilient stop already is effected by a small counter-excitation, hence leads to a considerable reduction of the magnetic holding force at the armature as a result of the changing distribution of the flux between working air gap and shunt. As regards the design and adjustment of the resilient stop it should correspondingly be considered that a sufficient vibration resistance of the system is maintained (insensitivity to inadvertent triggering). To improve the insensitivity to inadvertent triggering operations due to vibrations or also due to counter-excitations induced by interference fields, an additional electric excitation can be employed. For this purpose, the trigger coil can be used and be energized against that direction which is needed for triggering. However, an additional winding can also be used.

2.1. Variable Shunt Through Execution as Reversing Stroke Magnet

The positive feedback according to the invention also can be effected by a variably designed shunt. This means that on detachment of the armature—i.e. while the working air gap still is in the order of magnitude of the residual air gap—a movement of the armature, which increases the working air gap, results in a reduction of the reluctance of the shunt. For this purpose, the invention can be designed as reversing stroke magnet, wherein an end face of the armature together with the frame forms the working air gap of the self-holding magnet. The opposite end of the armature can form the shunt, wherein the shunt is designed as armature-armature counterpart system which preferably is designed such that the highest "force constant" occurs at the beginning of the stroke (i.e. in that position in which the working air gap is closed except for a residual air gap; the "tensioned" position). In this embodiment of the invention, a permanent-magnetically generated magnetic flux consequently is supplied to the armature, which corresponding to the associated reluctances is distributed on working air gap (without influencing the characteristic) and shunt (with influence on the characteristic, in order to open the working air gap). The counter-excitation by means of the associated coil then effects an increase of the reluctance force acting on the armature at the shunt and a decrease of the reluctance force at the "holding surface", i.e. at the working air gap. Shunt and accumulator spring exert a force on the armature in the same direction (to open the working air gap).

2.2. Useful Work Resulting from a Reduction of the Reluctance of the Variable Shunt by Means of a Second Armature A reduction of the flux-carrying shunt air gap (decrease of its reluctance) also can be effected by means of a second armature ("shunt armature"). This armature is movably arranged such that it is able to close the anyway small shunt air gap except for a residual air gap. The reluctance force acting on the shunt armature can be transmitted to the armature via a mechanical or hydraulic device with or without transmission, in order to open the working air gap (the force on the "shunt armature" hence should act on the (working) armature of the self-holding magnet in the same direction as the force of the accumulator spring). For force transmission a simple tappet can be used. In the tensioned condition of the drive, the shunt armature is in a position in which the reluctance of the shunt possibly is equal to the series reluctance of the (working) air gap(s). When a counter-excitation now is generated, the force acting on the shunt armature increases and is transmitted to the (working) armature in direction of the (accumulator) spring force acting on the (working) armature, i.e. acts to release the same from its stroke starting position. The magnetic holding force so to speak is reduced by the counter-excitation. The movement of armature and shunt armature finally effects a decrease of the reluctance of the shunt and an increase of the reluctance of the working air gap.

BRIEF DESCRIPTION OF THE DRAWINGS

The invention will be explained in detail below with reference to examples illustrated in the drawings. The representations are not necessarily true to scale and the invention is not only limited to the illustrated aspects. Rather, importance is placed on representing the principles underlying the invention. In the drawings.

In the Figures, identical reference numerals designate identical or similar components each with the same or a similar meaning.

DESCRIPTION OF THE INVENTION

Figure 1A:
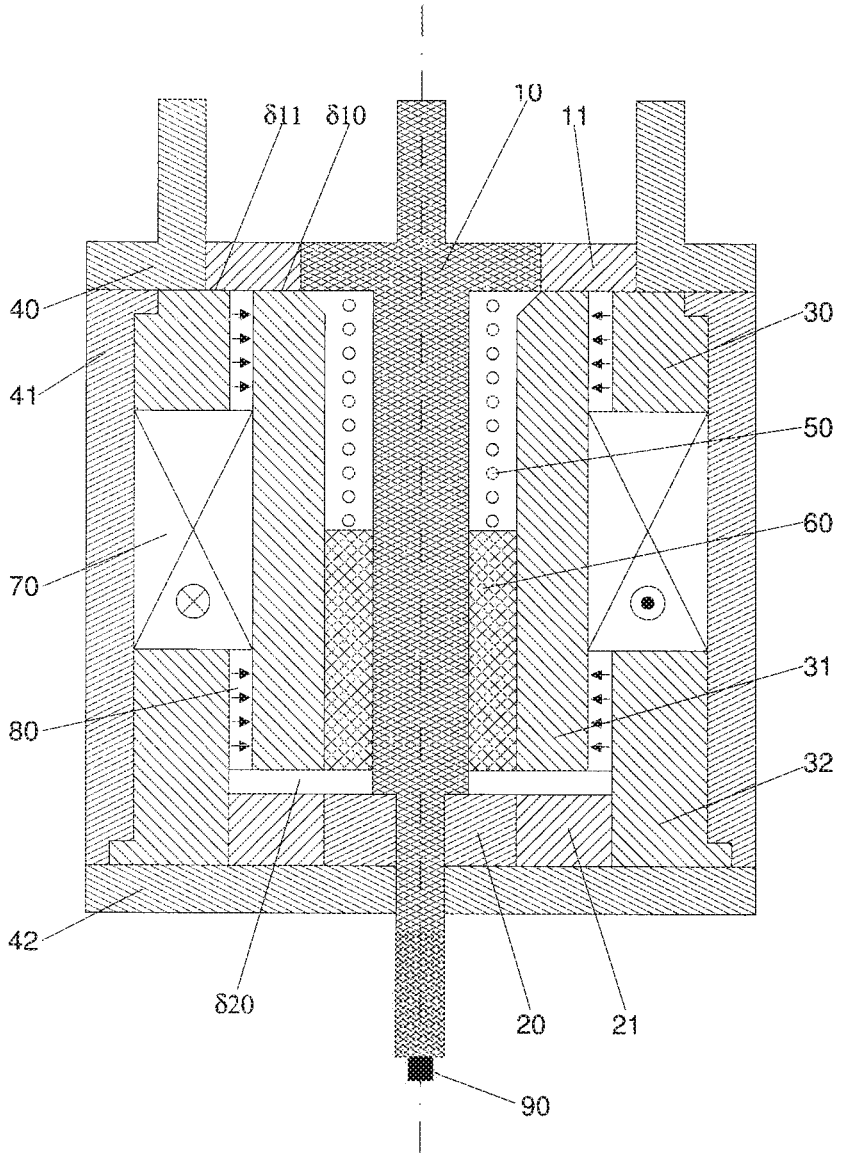
FIG. 1A shows a longitudinal section through a self-holding magnet according to the first example of the present invention.

FIG. 1A and FIG. 1A show an exemplary embodiment for a self-holding magnet 100 according to the invention with spring, which includes a shunt armature and a resilient stop 90. FIG. 1A shows a section through the approximately rotationally symmetrical drive. The drawing is not true to scale, but for the developer offers a good basis for FEM optimizations. The exemplary embodiment only serves for explanation and by no means is to be regarded as limitation.

The individual depicted components of the drive can be made of the following materials:

10 tappet to which the working armature is welded, austenitic stainless steel (NiCr)

11 working armature, silicon iron (FeSi)

20 carrier to which the shunt armature is welded (NiCr)

21 shunt armature (FeSi)

30 outer frame part (FeSi)

31 inner frame part (FeSi)

32 further outer frame part (FeSi)

40 armature guide (brass)

41 flux recirculation (FeSi)

42 shunt armature stop (NiCr)

50 spring (spring steel, can advantageously be designed as corrugated annular spring)

60 abutment for spring and plain bearing (bush) for tappet (bronze)

70 coil, wound into the groove of the frame part (enameled copper wire)

80 permanent magnet (in particular NdFeB)

A coil body can be omitted, when e.g. the groove in which the coil lies has an insulating coating.

δ10 and δ11 are the (series-connected) working air gaps in the tensioned stroke starting position and therefore closed except for the (non-illustrated) residual air gaps. δ20 is the shunt air gap which is utilized by the shunt armature 21 to perform work. The inner frame part 31 is chamfered in the region of the working air gap δ10.

Figure 1B:
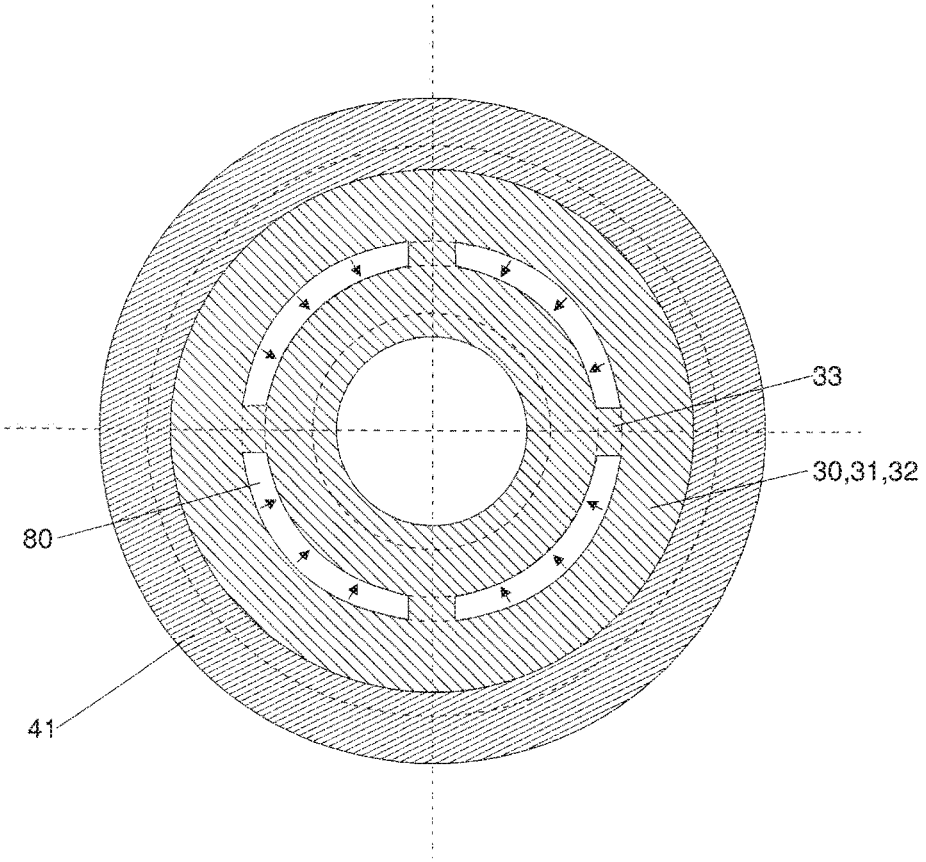
FIG. 1B shows a cross-section through a self-holding magnet according to the first example of the present invention.
Figure 2A:
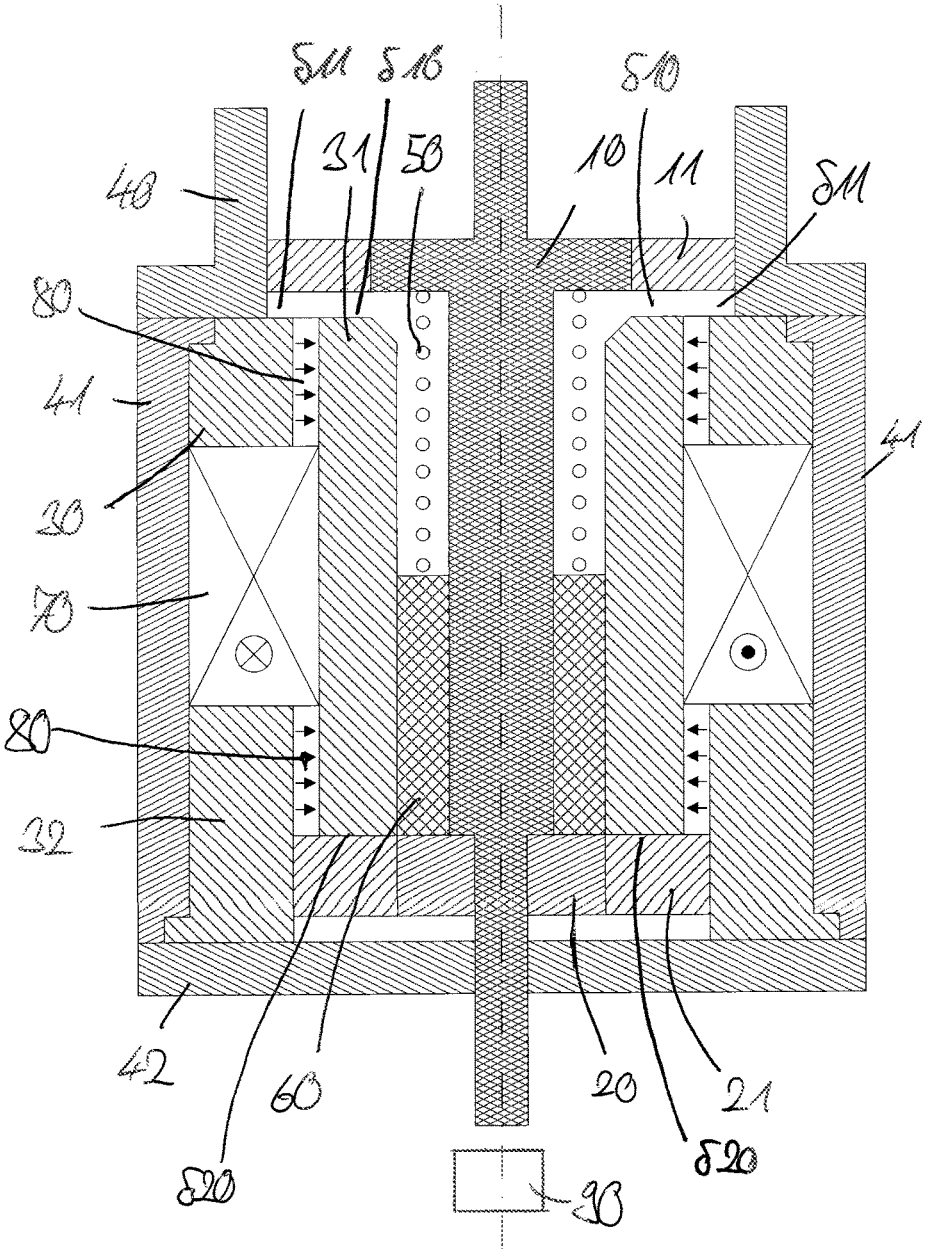
FIG. 2A shows a longitudinal section through a self-holding magnet in a half opened position.
Figure 2B:
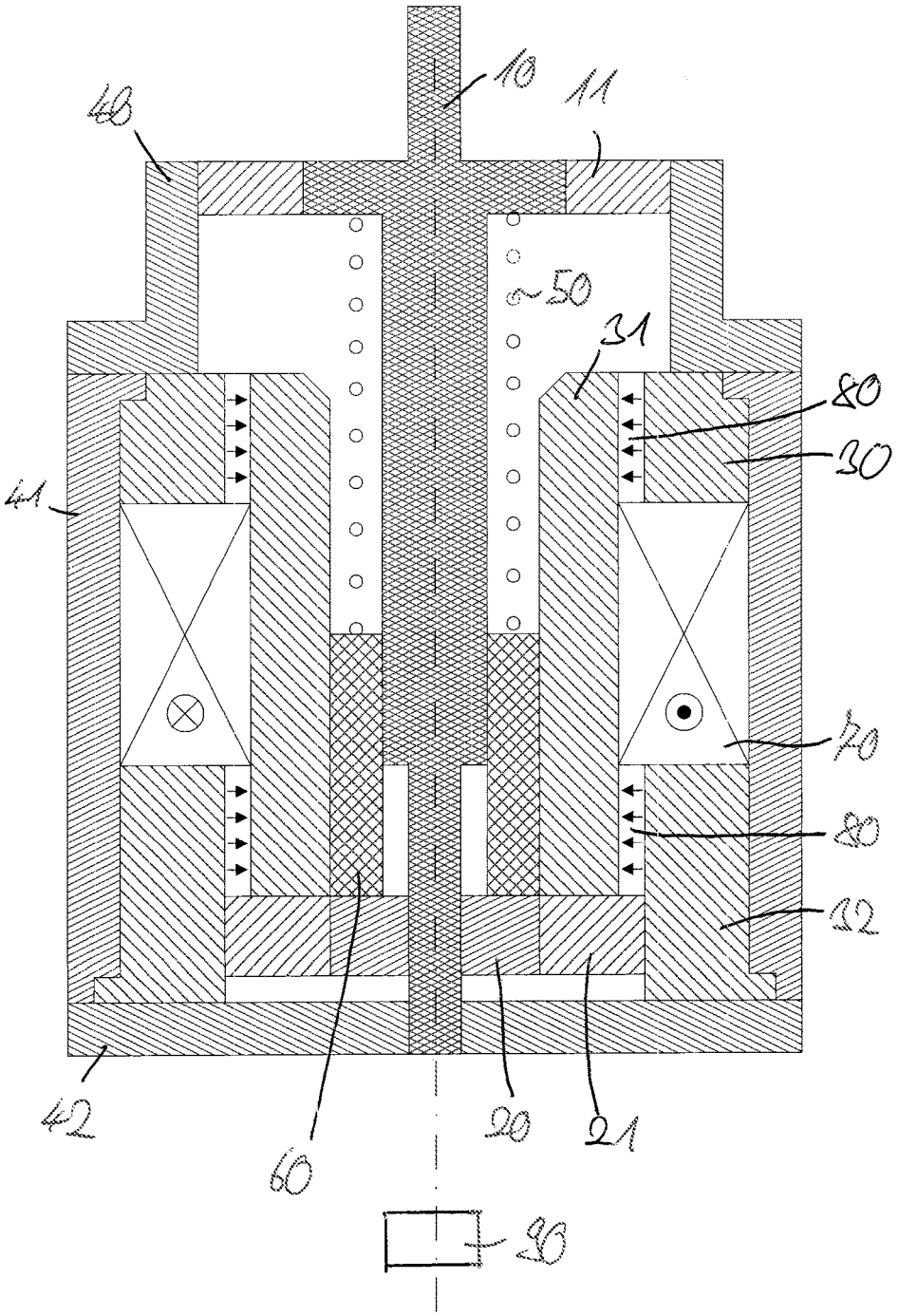
FIG. 2B shows a longitudinal section through a self-holding magnet in a fully opened position.

FIG. 1*b* shows a top view of the drive with removed armature guide and removed working armature and tappet. There are shown the permanent magnets consisting of radially polarized circular segments, which are located in cutouts of the (soft magnetic) frame. Reference numeral 33 designates constructive magnetic shunts, wherein the magnets are to be dimensioned such that these constructive magnetic shunts 33 saturate, so that a magnetic tension occurs between the inner frame part 31 and the outer region with outer frame part 30, 32 and flux recirculation 41. The construction with radially polarized circular segments, constructive (saturated) shunts etc. is comparatively expensive, but provides for a particularly high dimensional accuracy and thus very well satisfies the basic requirement of small residual air gaps.

Mode of Operation:

In the illustrated stroke starting position (tensioned condition), the shunt air gap δ20 possibly has the same reluctance as the series connection δ10, δ11 (but a larger cross-section). From the point of view of the coil, this can lead to a polarized (sic!) magnetic circuit of low reluctance, which provides for large force constants (N/A). Via the carrier 20, the shunt armature 21 acts on the tappet 10 welded to the working armature and thus additionally helps to overcome the holding force, which is conveyed via δ10 and δ11, and to accelerate the working armature. As a result of the series connection (sic!) of δ10 and δ11, opening of these residual air gaps by a given (small) length approximately effects an increase of their series reluctance twice as high as would be the case with a simple (small) working air gap. The shunt armature 21 starts to move, so to speak, and helps to move the working armature not only by means of the carrier 20, but additionally withdraws flux from the working air gaps δ10, δ11, since a closing movement of the shunt armature leads to a reduction of the reluctance of the shunt and the same is connected in parallel with the working air gaps with respect to the permanent-magnetically generated flux. As mentioned, the (electric) sensitivity of this drive can be increased further, in that it is equipped with a resilient stop of suitable stiffness. This stop (not shown) for example can make use of a disk spring and act on the tappet 10. Pretensioning the disk spring or changing its rest position, wherein the fine adjustment can be effected by means of screws with fine threads, then provides for an adjustment of the electric sensitivity of the drive. It can be advantageous to connect the drive according to the invention in series with a diode and to connect a varistor in parallel with the drive, as during opening a voltage is induced in the coil which is opposite to the triggering voltage. Such external wiring can considerably shorten the triggering time. By using a resilient stop, triggering proceeds as follows:

Electric counter-excitation reduces the flux through working air gaps δ10, δ11 and increases the one through the shunt air gap δ20. Due to the resilient stop, a minimal energization already leads to a certain decompression. As a result of this decompression, δ10 and δ11 are increased, while δ20 decreases correspondingly (since the shunt armature 21, accelerated by reluctance force, follows the tappet 10). Because said air gaps all are small, this small deflection of the system—the decompression—leads to a markedly different distribution of the permanent-magnetically generated flux: The flux through the working air gaps δ10, δ11 decreases, the one through the shunt increases. The rapid increase of the force acting on the shunt armature 21 contributes to triggering of the self-holding magnet and because of the force additionally transmitted to the working armature 11 via carrier 20 and tappet 21 and the magnetic "short-circuiting" of the working air gaps δ10, δ11 also provides for a considerable shortening of the achievable actuating times, as in conventional self-holding magnets, in any case at low triggering powers, only small forces from the difference of the spring force and the reluctance force are available for the acceleration of the armature in the surroundings of the stroke starting position. In the exemplary embodiment on the other hand the reluctance force inhibiting the armature movement is short-circuited with the associated flux as a result of the movement of the shunt armature, while the working armature 11 is driven by the reluctance force acting on the shunt armature 21 in addition to the spring force.

The invention claimed is:

1. A self-holding magnet, comprising:

a magnetic circuit having a stator and a first armature;

a stop;

said stop defining a first stroke end position, in which between said stator and said first armature one or more working residual air gaps are present, which have a series reluctance;

at least one spring disposed to exert a spring force urging said first armature away from said stop;

a magnetic shunt of particularly low reluctance;

one or more permanent magnets for exciting the magnetic circuit and one or more coils for counter-exciting the magnetic circuit;

wherein:

the magnetic circuit is dimensioned such that the magnetic circuit is able to magnetically hold said first armature in the first stroke end position against the spring force;

said magnetic shunt has a reluctance which is of the same order of magnitude as the series reluctance of the working residual air gap(s);

working air gap(s) and said shunt are magnetically connected in parallel with respect to the permanent-magnetically generated flux, but are connected in series with respect to the flux generated by said trigger coil(s);

said coil(s) are energized such that the magnetic flux in the working air gap(s) is attenuated and the magnetic flux in the shunt is increased, leading to a relaxation of the spring when a amount of the magnetic holding force falls below the spring force;

one or more positive feedback devices selected from the following group of devices:

(1) said stop, being a resilient stop, said resilient stop having spring properties and being very much stiffer than said at least one spring and much less stiff than a solid stop of iron; and (2) design of the magnetic shunt such that a movement of said first armature results in a reduction of the reluctance of said magnetic shunt, so that a permanent-magnetically generated flux increasingly commutates onto said shunt with an onset of a movement of said first armature.

2. The self-holding magnet according to claim 1, wherein commutating of the permanent-magnetically generated flux onto said shunt is achieved in that:

the shunt comprises a shunt armature configured to transmits a reluctance force acting on the same to the first armature, so that a counter-excitation by said coil(s) leads to a decrease in a flux in the working air gap(s) of said first armature and an increase of a flux in one or more shunt working air gap(s) of said shunt armature;

as soon as an amount of a total reluctance force acting on said first armature and shunt armature together falls below the spring force, said shunt armature also starts to move along with said first armature, in order to close the shunt working air gap(s), which results in a reduction of the reluctance of a flux path leading over said shunt armature.

3. The self-holding magnet according to claim 1, wherein commutating of the permanent-magnetically generated flux onto said shunt is achieved in that:

the self-holding magnet is configured as a permanently excited reversing stroke magnet, wherein the armature has a first side having no geometric influence on the characteristic with the stator, so that a magnetic holding force as high as possible is generated against the spring force, while on the opposite side of the armature, where the armature is subject to a reluctance force in direction of a spring force generated by the compression of the spring, said armature comprises the shunt, with the shunt and said stator having a geometric influence on the characteristic.

4. A self-holding magnet, comprising:

at least one spring and an armature, wherein said armature is configured to be held in a stroke position against a spring force, said stroke position being determined by a stop;

said stop determining at least a residual air gap of a working air gap;

a magnetic circuit of the self-holding magnet having a magnetic shunt with a particularly low reluctance that is of a same order of magnitude as a series reluctance of the working residual air gap or gaps;

with respect to a permanent-magnetically generated flux, the working air gap or air gaps and said shunt are magnetically connected in parallel;

with respect to a flux generated by a coil, the working air gap or air gaps and said shunt are connected in series; and at least one of the three following positive feedback devices:

said stop being a resilient stop that is much stiffer than said at least one spring but much less stiff than a solid stop of iron;

said shunt being configured such that a movement of said armature leads to a reduction of a reluctance of said shunt, in that the self-holding magnet is configured as a reversing stroke magnet, wherein a holding force which can keep the accumulator spring tensioned is generated, and said shunt is formed as armature-armature counterpart system;

said shunt being configured such that a movement of said armature leads to a reduction of the reluctance of said shunt, in that said shunt is provided with a shunt armature that is able to close a small air gap of said shunt except for a certain (still smaller) residual air gap, wherein a force acting on said shunt armature is transmitted to the armature of the self-holding magnet such that it acts thereon in a same direction as a force of said accumulator spring.

5. The self-holding magnet according to claim 4, wherein the resilient stop is adjustably mounted with respect to a pretension and/or a position thereof, allowing a sensitivity of the self-holding magnet to be adjusted.

6. The self-holding magnet according to claim 4, wherein said shunt is not configured as a geometrically determined air gap but by way of a material with distributed air gap.

7. The self-holding magnet according to claim 4, wherein said shunt or an associated flux guide is dimensioned and shaped such that, as a result of saturation, the reluctance of an iron circuit seen by the coil can increase to the effect that even with a comparatively high counter-excitation an inadvertent retention of the armature in its stroke starting position or inadmissibly delayed triggering is avoided.

8. The self-holding magnet according to claim 4, wherein said at least one spring is a corrugated annular spring.

9. The self-holding magnet according to claim 4, wherein one or more armatures are round.

10. The self-holding magnet according to claim 4, wherein said at least one spring has such a degressive characteristic that a spring force initially increases on relaxation of the spring.

11. The self-holding magnet according to claim 4, wherein said resilient stop is between 100 and 1000 times stiffer than said at least one spring.

* * * * *